United States Patent [19]

Romano et al.

[11] 4,245,474

[45] Jan. 20, 1981

[54] THERMODYNAMIC SYSTEMS FOR GENERATING MECHANICAL ENERGY

[76] Inventors: Giuliano Romano, Viale dei Mille 83; Nedo Marilli, Via F. Gianni 5, both of Florence; Riccarda Gonfiotti, Via XXIV Maggio 61, Montevarchi, Arezzo, all of Italy

[21] Appl. No.: 961,543

[22] Filed: Nov. 17, 1978

[51] Int. Cl.[3] ..... F01K 25/00

[52] U.S. Cl. ..... 60/519; 60/650

[58] Field of Search ..... 60/517, 519, 525, 650, 60/682

[56] References Cited

U.S. PATENT DOCUMENTS

| | | | |
|---|---|---|---|
| 3,744,245 | 7/1973 | Kelly | 60/519 |
| 4,077,221 | 3/1978 | Maeda | 60/650 |

FOREIGN PATENT DOCUMENTS

| | | | |
|---|---|---|---|
| 2288856 | 5/1976 | France | 60/650 |

*Primary Examiner*—S. Clement Swisher

*Attorney, Agent, or Firm*—McGlew and Tuttle

[57] ABSTRACT

A thermodynamic system for generating mechanical energy comprises a source of high-temperature and high-pressure fluid and a source of low-temperature and low-pressure fluid. Two coupled rotary elements form, respectively, a motor with an increasing volume chamber where the high-temperature, high pressure fluid expands to generate mechanical energy, and a compressor in which cold fluid is compressed. Two further elements with variable volume chambers are cyclically placed in communication with high-temperature source for the transfer of the fluid from the compressor towards said source and for the transfer of fluid from the source to the motor.

5 Claims, 10 Drawing Figures

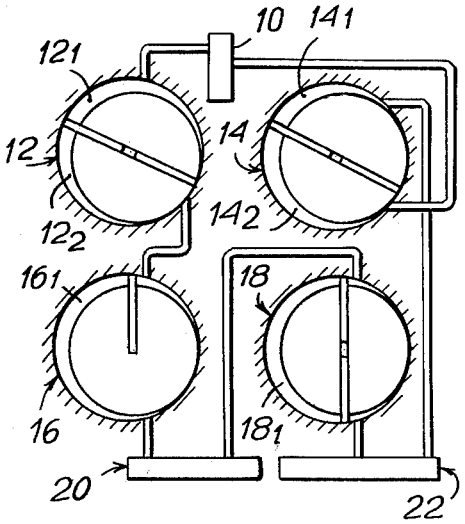
Fig.1
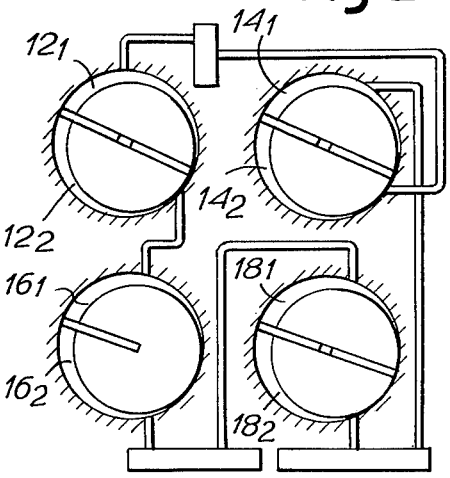
Fig.2
Fig.3
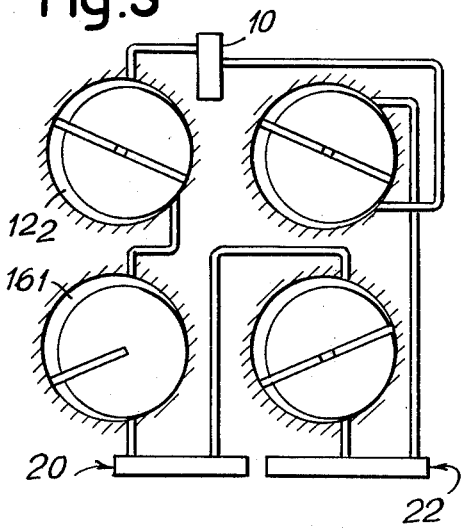
Fig.4
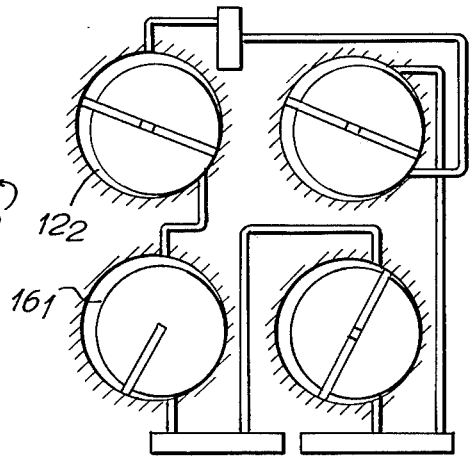

THERMODYNAMIC SYSTEMS FOR GENERATING MECHANICAL ENERGY

FIELD OF THE INVENTION

The present invention relates to thermodynamic systems for generating mechanical energy in open or closed cycles.

SUMMARY OF THE INVENTION

According to the present invention, there is provided a thermodynamic system for generating mechanical energy, said system comprising means defining a low-pressure, low-temperature, fluid source, means defining a high-pressure, high-temperature, fluid source, means defining a motor, means defining a first variable-volume chamber, said first chamber acting to transfer fluid from the high-pressure source to the motor, means defining a second variable volume chamber, said second chamber communicating cyclically with the high-pressure source to transfer fluid from the low-pressure source to the high-pressure source with no mechanical work.

Further according to the present invention, there is provided a thermodynamic system for generating mechanical energy, comprising means defining a first fluid source energy which is continuously heated to a high-temperature and high-pressure, means defining a second fluid source in which the fluid is at low-temperature and at low-pressure, first and second coupled rotary elements, said first element forming a motor having an increasing-volume chamber in which high-temperature fluid expands to generate mechanical work and said second element forming a compressor in which cold fluid is compressed, and two further elements each having a variable-volume chamber, the chamber of one of said further elements being cyclically placed in communication with the high-temperature source to transfer fluid from the compressor towards the high-temperature source, and the chamber of the other of said further elements being cyclically placed in communication with the high-temperature source to transfer fluid from the high-temperature source to the motor.

BRIEF DESCRIPTION OF THE DRAWINGS

Embodiments of the invention, will now be described, by way of example only, with reference to the accompanying diagrammatic drawings, in which:

FIGS. 1 to 6 show schematically, different stages in the cycle of operation of a thermodynamic system in accordance with the invention;

Figure 7:
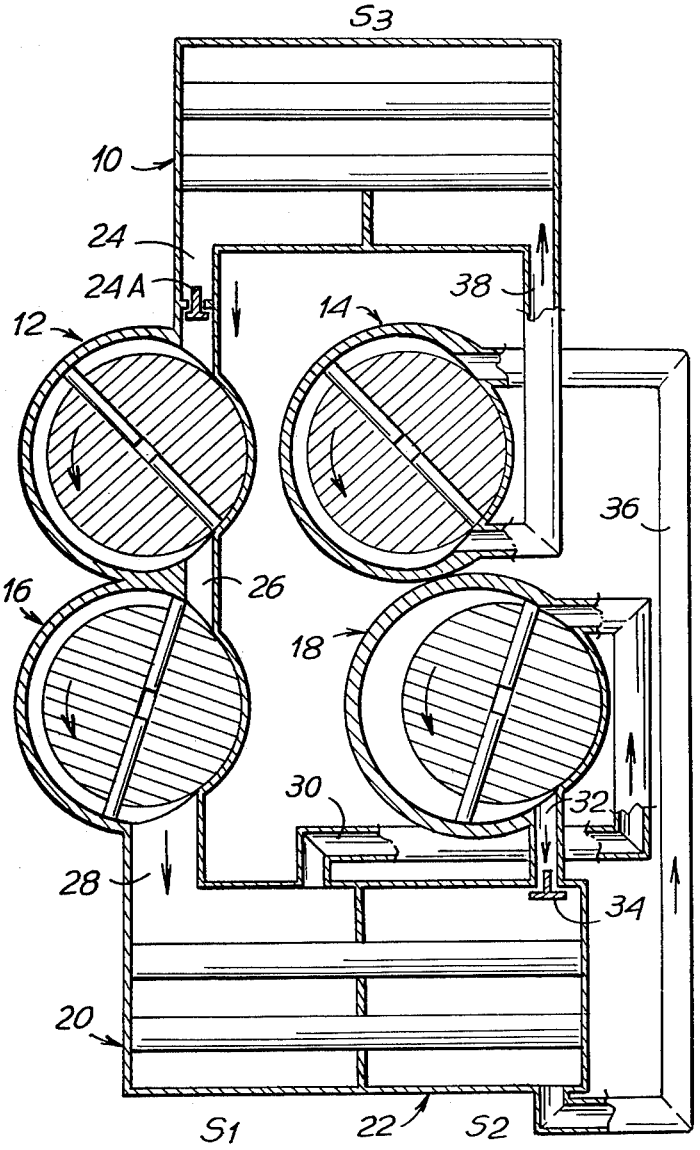
FIG. 7 is a schematic cross-section of the system shown in FIGS. 1 to 6.

Referring first to FIG. 7, the system comprises a high-pressure, high-temperature, gas source 10 (hereinafter referred to as the "hot" source), the source being maintained in the foregoing conditions by means of a continuous combustion and by indirect heating of the gas, which may be air. The heating of the hot source is independent of the cyclic operation of the system.

Numerals 12 and 14 denote two rotary elements having eccentric rotors coupled with each other. These rotors each have at least one vane (and, as shown, two vanes) which vanes define, during their rotation, respective variable-volume chambers. Numerals 16 and 18 denote two further rotary elements having rotors coupled with each other. These elements are also provided with one or two vanes to define variable-volume chambers during rotation of the elements. The rotary elements 16 and 18 are independent of the elements 12 and 14.

Numerals 20 and 22 denoted two sections of a low-temperature gas source (hereinafter referred to as the "cold" source) at a different pressure to that of the hot source.

The hot and cold sources are of unrestricted volume and are volumetrically independent of the elements 12 to 18.

The hot source 10 communicates—through a conduit 24 provided with a non-return valve 24A—with the chambers of the rotary element 12 which increase in volume. The chambers of the element 12 which decrease in volume are in communication, through a passage 26, with the increasing-volume chambers of the rotary element 16. The decreasing-volume chambers of the rotary element 16 communicate by means of a passage 28 with the section 20 of the cold source. The rotary element 16 acts as a motor which delivers mechanical energy. The rotary element 18 is interposed between the sections 20 and 22 of the cold source and communicates therewith via an inlet passage 30, and an outlet passage 32 which preferably incorporates a non-return valve 34. The rotary element 18 acts as a compressor and, as previously mentioned, its rotor is coupled to that of element 16 and the elements are both mechanically separate from the rotary elements 12, 14. The section 22 of the cold source is in communication through a passage 36 with the increasing-volume chambers of rotary element 14, whereas the decreasing-volume chambers of this element communicate with the hot source 10 through a passage 38.

Figure 8:
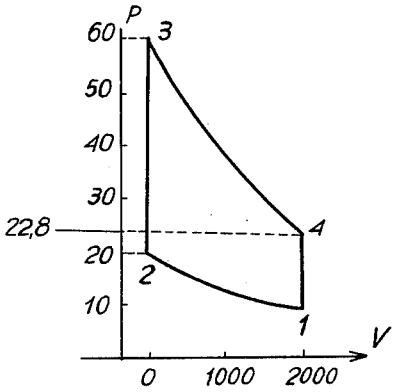
FIGS. 8 and 9 are graphs representing the thermodynamic cycle.
Figure 9:
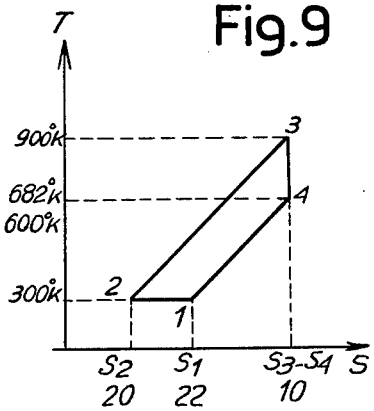

In the cycle diagrams of FIGS. 8 and 9, the numerals 1, 2, 3 and 4 show characteristic points, to which characteristic values of the sources $S_1$, $S_2$, and $S_3$, $S_4$ of the cold 20, 22 and hot 10 sources correspond.

In FIGS. 1 to 6 the rotary elements are shown schematically in different positions which they assume during operation. It is to be noted that during each cycle, the rotors of the rotary elements 12 and 14 have an intermittent motion.

The explanation of the operation of the described system will now be given by means of a quantitative example which is merely representative and is not intended to be limitative.

The cycle now to be described by way of example has the following parameters, which remain substantially constant throughout: temperature of the sections 20, 22 of the cold source—approximately 300° K.; temperature of the hot source 10—approximately 900° K.; pressures in sections 20 and 22—approximately 10 atmospheres, and 20 atmospheres, respectively; and pressure of the hot source 10—approximately 60 atmospheres. The compression ratio of the rotary element 18 is of the order of ½.

In the stage shown in FIG. 1, there is in the chamber $12_1$, and in the chamber $12_2$, a pressure of 60 atmospheres; in the chamber $16_1$, the pressure is 10 atmospheres this being the final pressure of adiabatic expansion in the element 16 and corresponding to the pressure of source 20 which is the minimum pressure in the cycle; in the chamber $18_1$, there is a pressure of 20 atmospheres, which is the final compression pressure of the element 18; in the chamber $14_1$ there is again a 20 atmospheres pressure, corresponding to that of source 22; in the chamber $14_2$ there is a pressure of 60 atmospheres, corresponding to that of hot source 10.

In the stage shown in FIG. 2, after a partial expansion of the gas (e.g. an expansion of about 300 cc. over a volume of 1000 cc. of the variable-volume chambers) the following pressures prevail: chamber $12_1$—60 atmospheres; chambers $12_2$ and $16_1$—about 41.5 atmospheres; chamber $16_2$—10 atmospheres; chambers $18_1$ and $18_2$—10 and 20 atmospheres, respectively; and chambers $14_1$ and $14_2$—20 and 60 atmospheres, respectively.

After an expansion up to 600 cc. in the stage shown in FIG. 3, the conditions remain similar to those of FIG. 2, except that in the chambers $12_2$ and $16_1$ there is a pressure of 31 atmospheres.

In the stage shown in FIG. 4, the chambers $12_2$ and $16_1$ the gas is further expanded to a pressure of 24.4 atmospheres.

Figure 5:
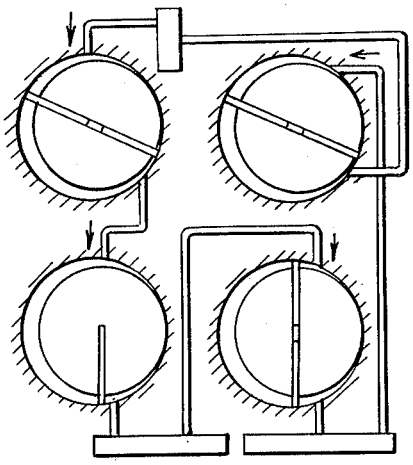

In the stage shown in FIG. 5, the gas is further expanded in the chambers $12_2$ and $16_1$ to about 22.7 atmospheres.

During the above mentioned stages, the rotors of the rotary elements 12 and 14 remain stationary, while the rotors of the rotary elements 16 and 18 have rotated respectively to produce mechanical energy and to compress the cold fluid from section 20 to section 22 of the cold source.

Figure 6:
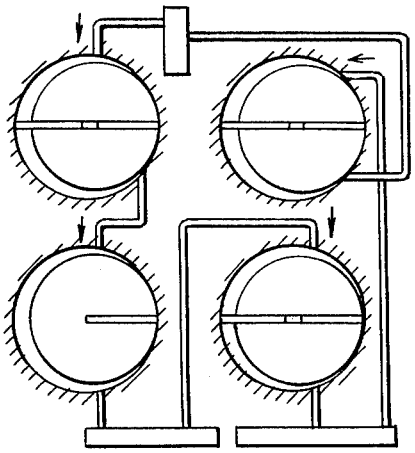

In the stage of FIG. 6, a partial rotation of the rotors of rotary elements 12 and 14 has occurred in addition to a further angular advancement of the rotors of rotary elements 16 and 18.

In practice, the rotors of the motor and compressor-forming elements, that is the elements 16 and 18, rotate continuously while the rotors of the elements 12 and 14 advance intermittently and independently of that of the other rotors, the rotors of the elements 12 and 14 being mechanically connected with each other.

By the described arrangement particular advantages of structural and functional simplicity and high efficiencies are reached.

Figure 10:
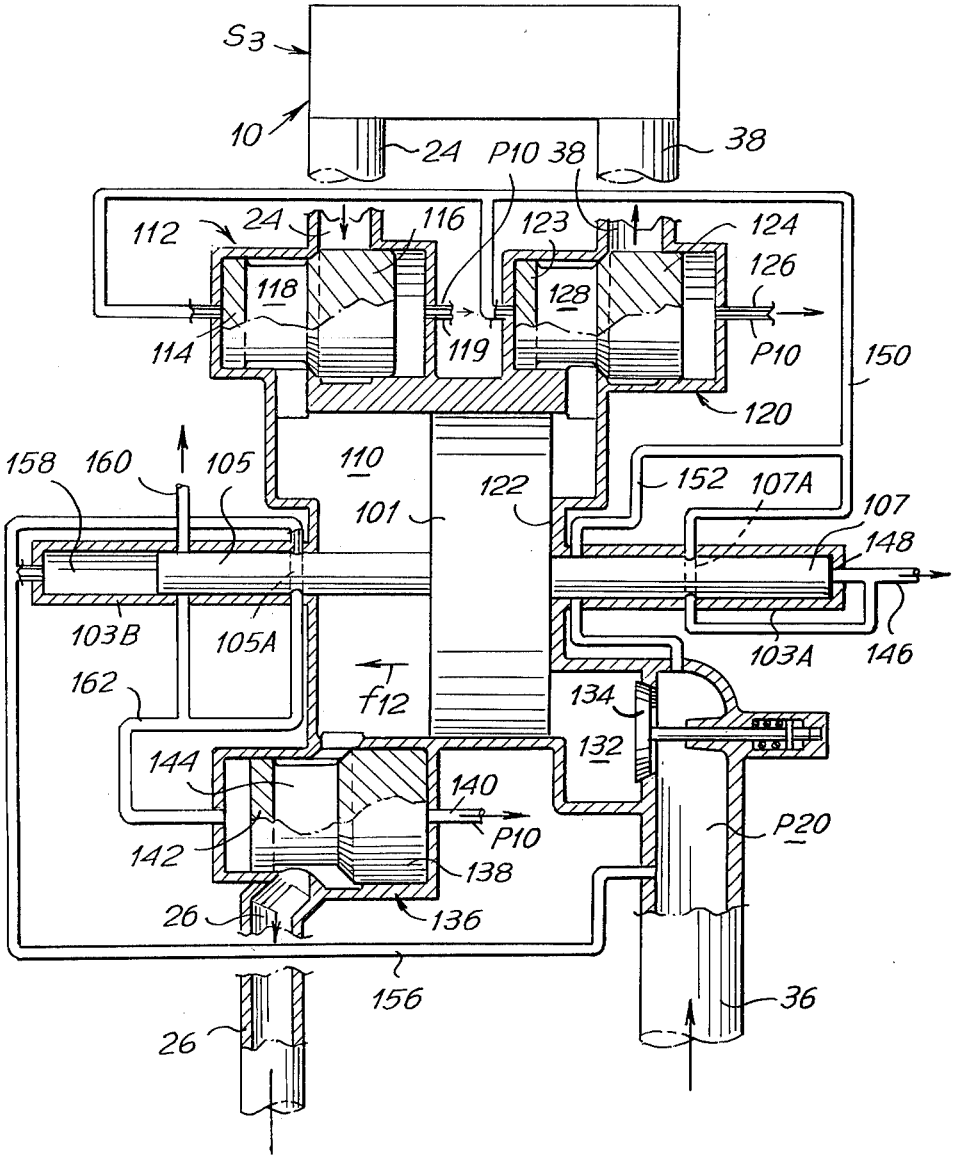
FIG. 10 is a fragmentary cross-section of a modified system.

The system shown in FIG. 10 is similar to that of FIG. 7, except that the coupled rotary elements 12 and 14 are replaced by piston/cylinder assemblies. There is shown in FIG. 10 the hot source 10 which is connected by the passages 24 and 38 with the piston/cylinder assemblies which replace the rotary elements 12 and 14. In FIG. 10, the passages 26 and 36 which reach the rotary elements equivalent to the elements 16 and 18 of FIG. 7 are also shown.

In the system of FIG. 10, numeral 101 denotes a piston which slides in a cylinder 103 which is extended by a pair of rod-like elements 105, 107 each of which forms a distribution slide. Three slide valves are coupled to the cylinder 103, these valves being controlled by the pressure differential (e.g. of 20 atmospheres and of 10 atmospheres) prevailing in the two sections of the cold source corresponding to that of the preceding example. More particularly, the conduit 24 communicates with a space 110 of the cylinder 103 via a first valve 112 having a slide with a portion 114 of smaller effective than that of portion 116, the slide being transversed by a central passage 118. The portion 116 is acted upon by the pressure of section $S_1$ and which is fed through a conduit 119, this pressure being, for example 10 atmospheres denoted by $P_{10}$.

A second, like, slide valve 120 is interposed between the passage 38 and a space 122 of the cylinder 103 opposite the space 110 thereof. This slide valve likewise has a slide with portions 123 and 124 of different effective area, the larger area portion 124 being subjected to pressure $P_{10}$ through a conduit 126 connected, like the conduit 119, to the lower pressure section $S_1$ of the cold source. Numeral 128 denotes a central passage in the slide of the slide valve 120. A space 132 connected to space 122 is placed downstream of a non-return valve 134 inserted in the passage 36, in which a pressure $P_{20}$ prevails, for example a pressure of 20 atmospheres, corresponding to that of section $S_2$ of the cold source, downstream of the compressor formed by the rotary element 18.

A third, like, slide valve 136 is interposed between the space 110 of the cylinder 103, and the motor formed by the rotary element 16. A larger area portion 138 of the slide of the valve 136 is subjected, by means of a conduit 140, to the same pressure $P_{10}$. The slide of the valve 136 has a smaller area portion 142 and is traversed by a passage 144.

The conduits 119, 126, 140 and a conduit 146 are constantly fed with the lower pressure of the cold source. The conduit 146 leads into a piston/cylinder assembly denoted by 148 and formed by the rod-like extension 107 of the piston 101 and by an extension 103A of the cylinder 103. A conduit 150 leading from the conduit 146 feeds the low pressure to the smaller slide portions 114 and 123 of the valves 112 and 120 under the control of the distribution slide valve formed by the piston extension 107, which has for this purpose a through-passage 107A. A conduit 152 leading to the conduit 150 extends from the passage 36 (where pressure $P_{20}$ prevails) through the control of the distribution slide valve formed by the extension 107. Therefore, according to whether the piston 101 (and thus its extension 107) is positioned at the end of its stroke towards the right or towards the left as viewed in FIG. 10, there is applied to the smaller portions 114 and 123 of valves 112 and 120, pressures of 10 atmospheres and 20 atmospheres respectively.

Through a conduit 156 leading from the conduit 36, a pressure $P_{20}$, e.g. of 20 atmospheres, reaches a variable volume space 158 of a cylinder/piston assembly formed by piston extension 105 movable in an extension 103B of the cylinder 103; the piston extension 105, like the extension 107 also acts as a distribution slide-valve and is provided with a through-passage 105A cooperating with fixed ports in the extension 103B, one of which is fed with pressure $P_{10}$, e.g. of 10 atmospheres, by conduit 160, and the other of which is fed by conduit 156 with pressure $P_{20}$, e.g. of 20 atmospheres. The distribution slide-valve formed by the extension 105 feeds, alternately in the two positions of piston 101, one or the other of the two pressures to a conduit 162 leading to the variable volume space housing the smaller area portion 142 of valve 136.

The operation of the system of FIG. 10 is as follows, starting from the condition shown in the drawing. In this condition, the valves 112 and 120 are closed since—through the passage 107A of the distribution slide valve 107, 103A—the minimum pressure $P_{10}$ of 10 atmospheres for example, reaches the smaller area portions of these two slide valves and therefore the thrust exerted at the same pressure on the larger area portions 116 and 124 of the respective valves is predominent. The valve 136 is, however, held open by the passage of the pressure $P_{20}$, e.g. of 20 atmospheres which acts through conduit 156, passage 105A and conduit 162 on the smaller area portion 142 of the valve 136, the counterpressure $P_{10}$ (e.g. of 10 atmospheres) acting on the larger area portion 138 thereof being insufficient to overcome the force generated by pressure $P_{20}$ which acts on the smaller area portion. Therefore, the cylinder space 110 in which the pressure of the hot source prevailed e.g. the pressure of 60 atmospheres, diminishes in pressure while the fluid is transferred through passage 144 of valve 136, to reach the motor formed by the rotary element 16 in which the fluid expands to produce mechanical energy.

While the pressure in space 110 diminishes, for example from 60 atmospheres to 10 atmospheres minimum pressure (with consequent energy generation) the piston 101 moves in the direction of $f_{12}$ from the position shown in the drawing by the counterpressure acting in the cylinder space 122, this counterbeing maintained substantially at the value of $P_{20}$ by conduit 36 via the valve 134. With the movement of piston 101 towards the left, the distribution slide valve formed by extension 105 also moves whereby its passage 105A reaches the port corresponding to conduit 160. Thus the smaller area portion 142 of the valve 136 is subject to a pressure which falls from $P_{20}$ to $P_{10}$. This causes the slide of the valve to be shifted by the effect of the thrust exerted on its larger area portion 138 by the same pressure $P_{10}$ which is no longer overcome by the counterthrust on the smaller area portion 142. Thus the valve 136 closes the passage between space 110 and conduit.

At this time, the distribution slide valve 107 moves to feed the higher pressure $P_{20}$ to conduit 152 whereby an increase of pressure from $P_{10}$ to $P_{20}$ occurs on the smaller area portions 114 and 123 of the two valves 112 and 120. These valves are thus both opened, but with a slight delay following closure of the valve 136, in order to prevent a direct transfer of fluid under pressure through valves 112 and 136, and to dampen the piston end of stroke. Upon opening of the two valves 112 and 120, the pressures acting on the two opposed surfaces of piston 101 are equal, since on both these surfaces the maximum pressure of hot source 10 (that is $S_3$) acts through the passages 24, 38, 118 and 128 to reach the two variable volume spaces 110, 122 of the cylinder 103. When the pressures acting in the spaces 110, 122 are equal, the greater pressure which prevails in the space 158 thrusts piston 101 in a direction opposite to arrow $f_{12}$ against the lower pressure $P_{10}$, in the space 148. With this movement of piston 101, the cold gas at high pressure which is found in the space 122 is transferred to the hot source through the passage 128 of valve 120, while high-pressure and high-temperature gas enters the space 110 through the conduit 24 and the passage 118 of the valve 112, which is open. At the end of the piston stroke in the direction opposite to arrow $f_{12}$, there is a return to the conditions shown in FIG. 10, as the lower pressure is fed again through passage 107A of the distribution slide-valve 107 and valves 112 and 120, which shift again while closing, while valve 136 is reopened by the effect of pressure $P_{20}$, which reaches, through passage 105A the smaller area portion 142 of the valve 136. The cycle is then repeated.

The remaining parts of the system which have not been illustrated correspond in function and operations to those of the first embodiment.

It is to be noted that the gases reach the two sources in "gushes" which pulsate, and this effect causes good heat exchange.

Although the invention has been particularly described with reference to closed-cycle systems, it is also applicable to open cycle systems.

What is claimed is:

1. A thermodynamic system for generating mechanical energy, comprising means defining a first fluid source which is continuously heated to a high-temperature and high-pressure, means defining a second fluid source in which the fluid is at low temperature and at low pressure, first and second coupled rotary elements, said first element forming a motor having an increasing-volume chamber in which high-temperature fluid expands to generate mechanical work and said second element forming a compressor in which cold fluid is compressed, and two further elements each having a variable-volume chamber, the chamber of one of said further elements being cyclically placed in communication with the high-temperature source to transfer constant-volume fluid from the compressor towards the high-temperature source, and the chambers of the other of said further elements being cyclically placed in communication with the high-temperature source to transfer fluid from the high-temperature source to the motor.

2. A thermodynamic system according to claim 1, wherein the low-temperature source comprises first and second sections, the first section being at a pressure which is the minimum in the cycle and the second section being at a pressure which is the outlet pressure from the compressor, said compressor being located in a fluid flow path between said two sections.

3. A thermodynamic system according to claim 1, wherein the first and second rotary elements rotate continuously and are independent of said further elements.

4. A thermodynamic system according to claim 1, wherein said further elements comprise third and fourth rotary elements the third and fourth elements being mechanically coupled and rotating intermittently.

5. A thermodynamic system according to claim 1, wherein said further elements comprise piston/cylinder assemblies.

* * * * *